US005645306A

United States Patent [19]

Kosteniuk

[11] Patent Number: 5,645,306

[45] Date of Patent: Jul. 8, 1997

[54] BAG HANDLE

[76] Inventor: Steve Kosteniuk, 1813 Munroe Ave., Saskatoon, Canada, S7H 2G9

[21] Appl. No.: 649,017

[22] Filed: May 16, 1996

[51] Int. Cl.[6] ..... B65D 33/06

[52] U.S. Cl. ..... 294/137; 294/158

[58] Field of Search ..... 294/137, 158, 294/170, 171; 383/6, 13, 15, 25; D9/434, 455

[56] References Cited

U.S. PATENT DOCUMENTS

| | | | |
|---|---|---|---|
| 270,917 | 1/1883 | Turner | 294/170 |
| D. 356,261 | 3/1995 | Miceli, Jr. | 294/137 |
| D. 362,386 | 9/1995 | Blocker | 294/137 |
| D. 362,622 | 9/1995 | Van Davelaar | D9/434 |
| 4,023,762 | 5/1977 | Batts et al. | D9/434 |
| 4,420,178 | 12/1983 | Taylor et al. | 294/158 |
| 4,666,203 | 5/1987 | Castro . | |
| 4,841,596 | 6/1989 | Fink | 294/170 |
| 4,846,519 | 7/1989 | Leonard . | |
| 4,902,060 | 2/1990 | Nobakht . | |
| 5,026,105 | 6/1991 | Feldman . | |
| 5,029,926 | 7/1991 | Dieterich, Jr. . | |
| 5,487,581 | 1/1996 | Carmo et al. | 294/137 |
| 5,507,544 | 4/1996 | McQuade et al. | 294/170 |

FOREIGN PATENT DOCUMENTS

| | | |
|---|---|---|
| 2034939 | 7/1992 | Canada . |
| 1308402 | 10/1992 | Canada . |

OTHER PUBLICATIONS

Jay Norris Catalog Page, 1990.

*Primary Examiner*—Dean Kramer

*Attorney, Agent, or Firm*—Murray E. Thrift; Adrian D. Battison

[57] ABSTRACT

A bag handle is integrally molded from plastics material. It has a hand grip joined at the front end to a seat spaced below the hand grip. The seat has an upper arm joined to the front end of the hand grip, a circularly curved bight and a lower arm that projects to the front from the bight and curves upwardly as a hook to form a flared throat at the front of the handle. A retainer within the seat projects upwardly from the lower arm towards the upper in order to retain the handles of grocery bags and the like in the seat. The bight of the seat is located directly below the center of the hand grip to provide good balance.

13 Claims, 2 Drawing Sheets

BAG HANDLE

FIELD OF THE INVENTION

The present invention relates to bag handles and more particularly to handles that are especially useful with the type of plastic bag commonly used for carrying groceries.

BACKGROUND

Various bag handles have been used in the past. These suffer from certain disadvantages. Most of the known handles are formed as channels into which the plastic strip handles of the bags will fit. With a handle of this sort, when the bag is carried with the arm untwisted and the hand extending generally laterally of the body, the bags are oriented across the body so that they impede movement of the carrier's legs. Many of the known designs sacrifice simplicity in manufacture for comfort, or vice versa. Some handles do not balance the carried load well, placing considerable strain on the forearm and wrist.

The present invention is thus concerned with a novel bag handle that ameliorates problems with the known handles.

SUMMARY

According to the present invention there is provided a bag handle comprising:

a generally U-shaped seat including a lower arm, an upper arm and a bight joining the upper and lower arms;

an elongate hand grip including front and back ends; and means coupling the hand grip to the seat with the upper arm between the hand grip and the lower arm, and the bight located between the ends of the hand grip.

With this design, the bag is suspended below the center of the handle, providing excellent balance. The bags are oriented transversely of the hand grip so that interference with the legs when walking is minimized.

The handle is preferably an S-shaped, unitary plastic molding. The lower arm desirably curves up at the front as a hook to provide a tapered throat into which the bag handles can be gathered. The hook is preferably slightly resilient so as to open and close the throat slightly as bag handles are inserted and removed. The front part of the handle, between the hand grip and the seat, is also somewhat resilient, so that as the load increases the seat will drop slightly at the bight to ensure that the load is centered on the hand grip.

The tapered throat between the hook and the front member makes it easy to insert the handles of bags into the seat, or, more commonly, to capture the handles of bags with a simple manipulation of the handle.

BRIEF DESCRIPTION OF THE DRAWINGS

In the accompanying drawings, which illustrate an exemplary embodiment of the present invention.

DETAILED DESCRIPTION

Figures 1, 2, 3, 4, 5:
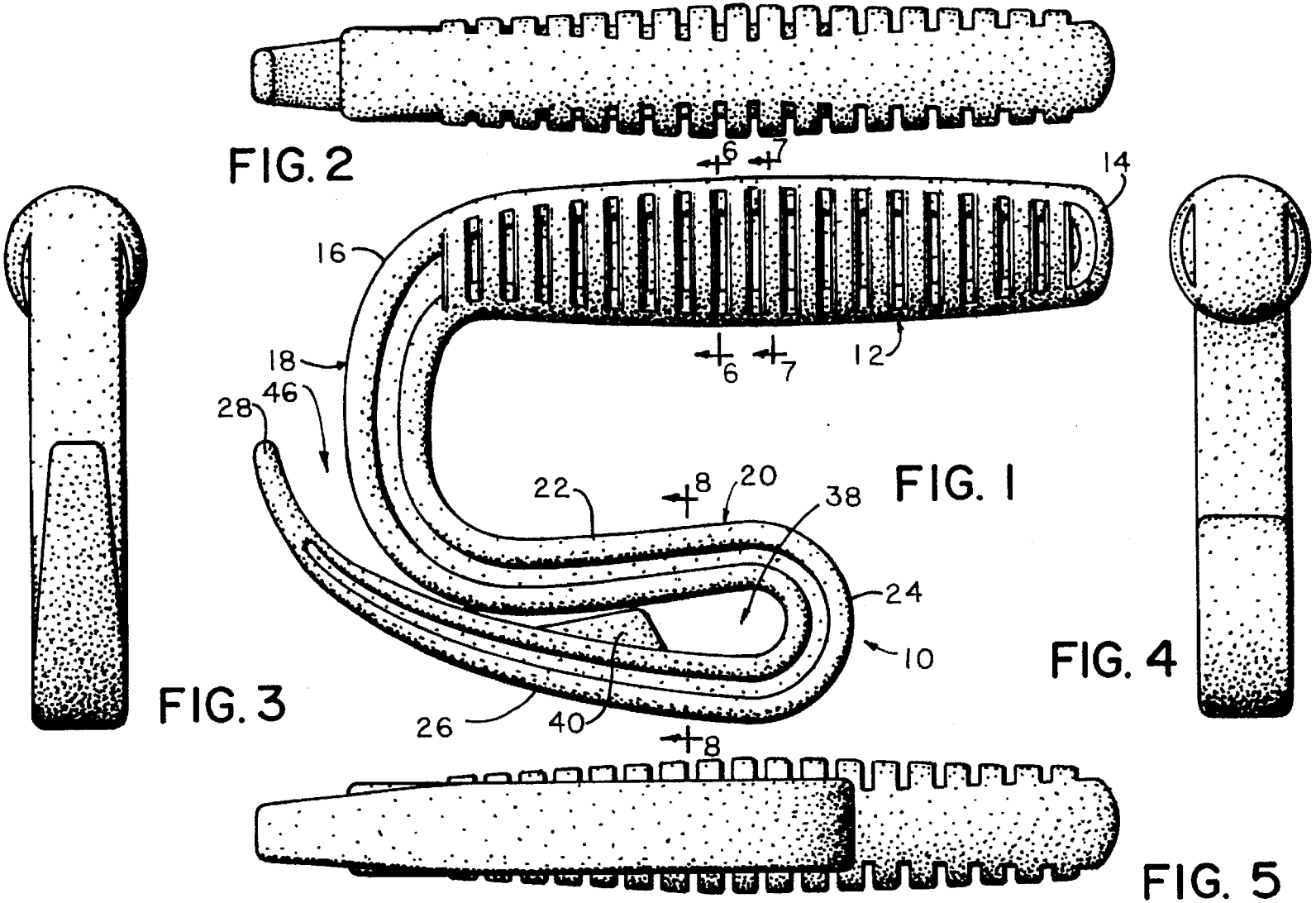
FIG. 1 is a side view of a handle according to the present invention.
FIG. 2 is a top view of the handle.
FIG. 3 is an end view of the handle.
FIG. 4 is an opposite end view of the handle.
FIG. 5 is a bottom view of the handle.
Figure 8:
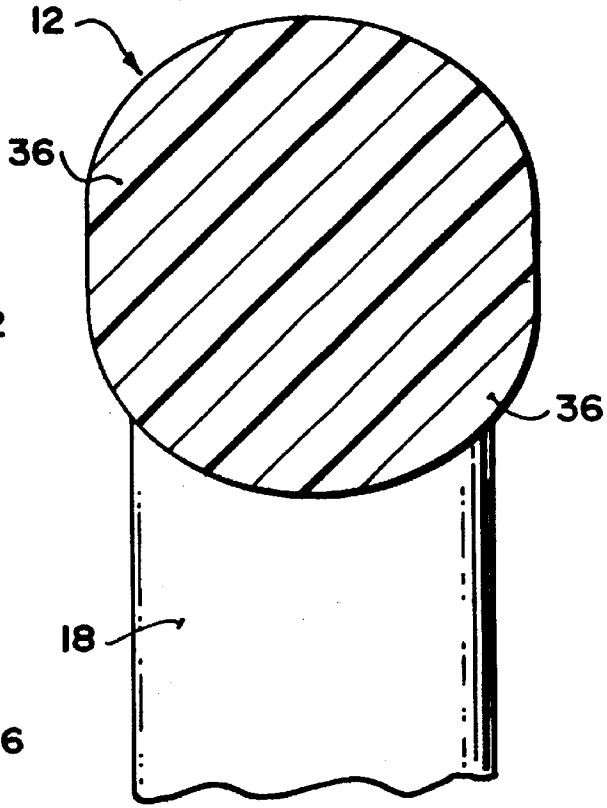
FIG. 8 is a view along line 8—8 of FIG. 1.
Figure 7:
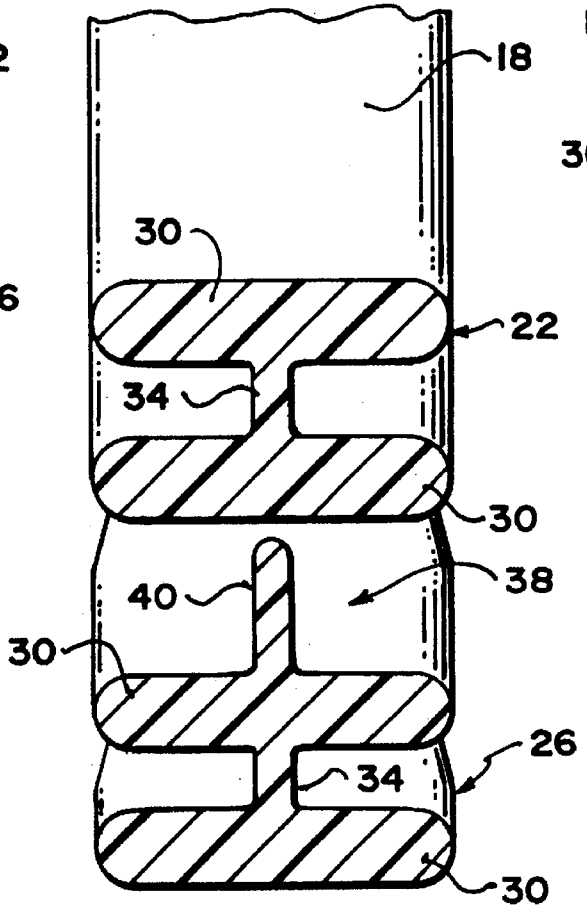
FIG. 7 is a view along line 7—7 of FIG. 1.
Figure 6:
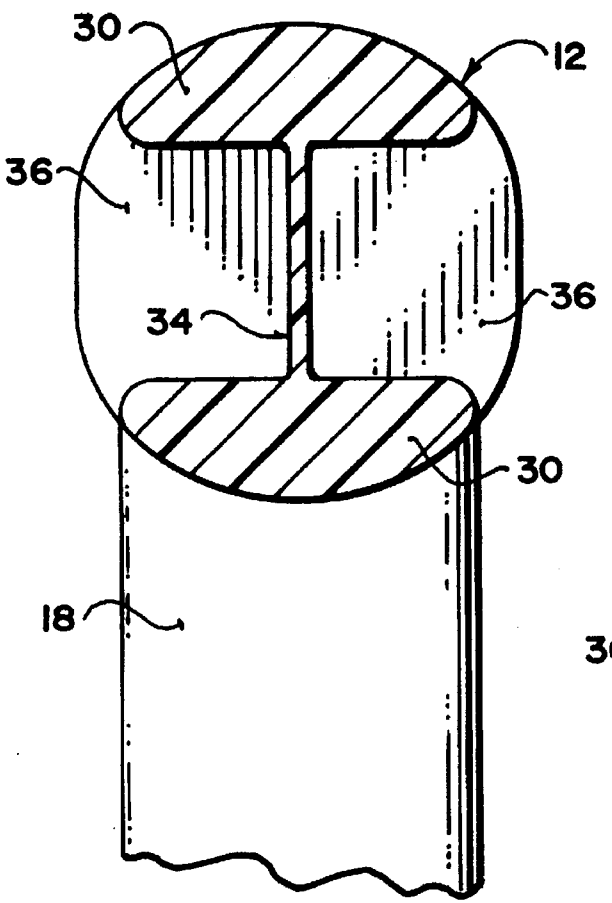
FIG. 6 is a view along line 6—6 of FIG. 1.

Referring to the accompanying drawings, there is illustrated a bag handle 10 that includes a hand grip 12 with a rounded back end 14 and a front end 16 that merges, through a downwardly extending front part 18 of the handle into a seat 20. The seat has an upper arm 22 that extends rearwardly from the front part 18. A bight 24 at the rear end of the upper arm 22 joins a lower arm 26 that extends forwardly below the upper arm 22. At the front end, the lower arm is tapered and curved upwardly to form a hook 28.

As shown in the cross-sectional views, the handle has a generally I-shaped section with two flanges 30 joined by a central web 34. This provides high bending resistance for the amount of material included in the product. It is also beneficial from the manufacturing point of view in that very thick plastic components are not required to be molded.

The comfort and rigidity of the handle are augmented with lateral ribs 36 extending outwardly from the web 34. The outer edges of the ribs merge into the outer surfaces of the flanges 30 and are convex to give the handle an overall rounded contour with a comfortable grip.

Within the seat 20 is a retainer 38. This is a triangular flange 40 that projects from the lower arm 26 towards the upper arm at a position slightly forwardly from the bight 24.

In use of the bag handle, the hand grip is held in the hand and the hook 28 is hooked under the plastic strip handles of a bag to be carried. The handles of the bag are forced past the retainer 38 by slight flexing of the seat. The forwardly and upwardly flaring throat 46 between the front part 18 of the handle and the hook 28 facilitates the capture of the handles of the bag. The retainer 38 retains the handles of the bag and keeps them centered under the hand grip while bags are being carried.

The bight of the seat accommodates the handles of the bag. This area has a circular contour to provide good strength. That part of the handle that connects the seat to the hand grip is slightly flexible and is well-rounded to provide strength and to provide adequate room for the forefinger at the front of the handle. The hand grip body is contoured to suit the hand grip.

Benefits to the user of the handle include simple and rapid loading and unloading of bags. Relatively little attention or hand coordination is required. The bag handles will not slip off the handle by accident. If the load is set down, the handle itself is easy to retrieve. The load is always balanced under the hand grip, which is beneficial for hand and arm comfort. With the hand grip oriented across the body, that is with the arms untwisted, the bags are correctly oriented for carrying.

As illustrated in FIG. 1 in particular, the lower arm 26 of the seat slopes upwardly to the front. This causes the handles of a carried bag to tend to move towards the bight, which is on a center line through the handle. When the handles of the bag rest on this center line, the handle feels balanced and the load causes the handle to tilt neither upward nor downward. Loaded bags pulling the flexible seat and the front part 18 downward augments this slope slightly, emphasizing the tendency for the handles of the carried bag to come to rest along the center line of the handle.

From the point of view of manufacturing, the handle consists of one part. It is manufactured in a single step. No assembly is required. The tooling required to make the handle is simple. It has no moving parts except for the basic ejection system in an injection mold.

While one embodiment of the present invention has been described in the foregoing, it is to be understood that other embodiments are possible within the scope of the invention and are intended to be included herein. One area where modifications may readily be done is in the retainer. This may, in other embodiments, be of various shapes or configurations. One possibility is a double retainer including flanges projecting from both the upper and lower arms in front of the bight, with a narrow gap between the two flanges. It is therefore to be understood that the present invention is to be considered limited solely by the scope of the appended claims.

I claim:

1. A bag handle comprising:

a single, generally U-shaped seat including a lower arm, an upper arm and a bight joining the upper and lower arms;

an elongate hand grip including a front end and a free back end; and means coupling the hand grip to the seat with the upper arm between the hand grip and the lower arm, and the bight centred between the ends of the hand grip, said means consisting of a front member extending from the front end of the hand grip to a front end of the upper arm of the seat, the seat and grip being otherwise unconnected.

2. A bag handle according to claim 1 wherein the lower arm of the seat has a front end portion comprising a hook projecting forwardly beyond the upper arm and curving upwardly and forwardly in front of the front member.

3. A bag handle according to claim 2 wherein the hook diverges from the front member to provide a tapered throat therebetween.

4. A bag handle according to claim 3 wherein the seat and hook slope downwardly, away from the handle in a direction from the throat towards the bight.

5. A bag handle according to claim 2 including a retainer extending from the lower arm towards the upper arm between the bight and the hook.

6. A bag handle according to claim 5 wherein the retainer comprises a flange extending along the lower arm.

7. A bag handle according to claim 6 wherein the retainer flange is substantially triangular.

8. A bag handle according to claim 2 wherein the hook is resiliently deformable.

9. A bag handle according to claim 2 wherein the hook tapers in cross-section to a front end thereof.

10. A bag handle according to claim 1 wherein the handle, the front member and the seat are integrally formed of plastic material.

11. A bag handle according to claim 10 wherein the bag handle comprises a generally S-shaped member with an I-shaped cross-section, including a central web and two flanges on opposite sides of the web.

12. A bag handle according to claim 11 including lateral ribs spaced along the handle, projecting from the central web to provide a round contour in cross section.

13. A bag handle according to claim 10 wherein the front member is resiliently deformable.

* * * * *